US005598202A

United States Patent [19]

Peterson

[11] Patent Number: 5,598,202

[45] Date of Patent: Jan. 28, 1997

[54] METHOD AND APPARATUS FOR PRINTING A GRAPHIC ON FABRIC

[75] Inventor: Mary E. P. Peterson, Delmar, N.Y.

[73] Assignee: Gerber Scientific Products, Inc., Manchester, Conn.

[21] Appl. No.: 404,192

[22] Filed: Mar. 13, 1995

[51] Int. Cl.[6] ..... B41J 2/325

[52] U.S. Cl. ..... 367/213

[58] Field of Search ..... 347/217, 212, 347/213; 400/120.18; 8/445, 446, 447, 467, 468, 470, 471

[56] References Cited

U.S. PATENT DOCUMENTS 4,527,171 7/1985 Takanashi et al. ..... 347/212

4,704,615 11/1987 Tanaka ..... 347/212

5,010,352 4/1991 Takei et al. ..... 347/217

FOREIGN PATENT DOCUMENTS 3-227286 10/1991 Japan .

*Primary Examiner*—Huan H. Tran

*Attorney, Agent, or Firm*—McCormick, Paulding & Huber

[57] ABSTRACT

A method for printing a graphic on fabric using a thermal transfer printer is disclosed. According to the invention, a colorant which forms the graphic and a binder for adhering the colorant to the fabric are printed on only those portions of the fabric covered by the graphic. Thermal transfer ribbons for carrying out the method of printing are also disclosed.

8 Claims, 2 Drawing Sheets

METHOD AND APPARATUS FOR PRINTING A GRAPHIC ON FABRIC

BACKGROUND OF THE INVENTION

The present invention relates to printing graphics, such as alphanumeric symbols, designs, logos and other artwork, on fabric. More particularly, the present invention relates to printing graphics on fabric using a thermal transfer printer.

Typically, graphics are printed on fabric using a thermal transfer process. In such a process a thermal transfer ribbon, including a colorant layer of pigment dispersed in a wax, resin or wax-resin vehicle, is used to print the desired graphic onto a thermally stable substrate, such as thermal paper, coated with a resin binder. The printed paper is then placed print side down on the fabric, and the colorant is transferred to the fabric in a press by the application of heat and pressure. The resin binder is also transferred, and the resin binds the colorant to the fabric.

Generally, the printed graphic is defined by one or more print areas covered by the colorant and adjacent "white" or non-print areas. However, since the entire surface of the thermal paper is coated with the binder, binder transfers to the fabric throughout this adjacent, non-print area, as well as in the areas covered by the colorant. The binder gives the non-print areas of the fabric an undesirable hand or texture and also seals the fabric weave together, which prevents the free passage air and moisture through the fabric in the non-print areas. Further, the resin binder is not transparent and leaves a shadow around the graphic. The resin shadow is particularly noticeable on colors other than white. Thus, the above-described method of printing is generally limited to use with white fabrics.

According to an alternative process, typically used in most high volume applications, the thermal transfer is prepared by screen printing or lithographically printing a desired graphic onto a thermally stable substrate. Since both processes employ inks instead of the pigmented wax or resin compounds described above in connection with thermal transfer ribbons, the resin binder and its associated disadvantages are eliminated. However, screen printing and lithographic printing, are labor intensive processes requiring artwork, ink mixing, color separation, printing screens or color separation films, a UV exposure step, and the use of emulsions, developers and other chemicals in addition to the inks. Moreover, the prepared screens or films can be use to print single size designs only.

It is, therefore, an object of the invention to provide a method for printing graphics on fabric which requires less labor and equipment than screen printing or lithographic printing and which does not require the inks and other chemicals used in these processes.

It is a further object of the invention to provide a method wherein the graphic is printed using a thermal printer and the final product is coated with binder in only those areas corresponding to the print area of the graphic.

It is yet another object of the invention to provide an apparatus for carrying out such a process.

SUMMARY OF THE INVENTION

The present invention meets these objects by providing, in one aspect, a method for printing a graphic on fabric using a thermal transfer printer having a first ribbon including a carrier layer and a layer of binder supported on the carrier layer, and a second ribbon including a carrier layer and a layer of a colorant supported on the carrier layer. The thermal printer is provided with data defining the graphic to be printed on the fabric, and the printer is activated to print binder with the first ribbon onto a thermally stable substrate according to the data. Thus, a print area including the binder and an adjacent non-print area without binder are formed on the substrate. Once the binder has been deposited on the substrate, the printer is activated to print colorant with the second ribbon onto the print area of the substrate according to the data. In the final step of the method, the graphic is printed on the fabric by thermally transferring the binder and colorant from the substrate to the fabric and adhering the colorant to the fabric with the binder.

In the preferred embodiment of this aspect of the invention, the printer has a single ribbon including a carrier layer, a colorant layer supported on the carrier layer, and a binder layer overlying the colorant layer. Accordingly, the steps of printing the binder and printing the colorant are performed simultaneously using the single ribbon.

According to a second aspect, the invention provides a method for printing a graphic directly on fabric in which the steps of printing the binder and colorant on a thermally stable substrate and then thermally transferring the binder and colorant to the fabric are eliminated. The method taught by this aspect of the invention utilizes a thermal transfer printer having a first ribbon including a carrier layer and a layer of colorant supported on the carrier layer, and a second ribbon including a carrier layer and layer of binder supported on the carrier layer. The printer is provided with data defining the graphic to be printed on the fabric, and the printer is activated to print colorant with the first ribbon onto the fabric according to the data. Thus, a print area including the colorant and an adjacent non-print area absent any colorant are formed on the fabric. The printer is then activated to print binder with the second ribbon onto the print area of the fabric according to the data to bind the colorant to the fabric.

In the preferred embodiment of this second aspect of the invention, the thermal printer has a single ribbon including a carrier layer, a binder layer supported on the carrier layer, and a colorant layer overlying the binder layer. Accordingly, the steps of printing the binder and printing the colorant are performed simultaneously using the single ribbon.

The invention is useful for printing graphics, either directly or by means of a transfer, on a wide variety of fabrics including cotton, polyester, cotton-polyester blends, wool, nylon, silk, rayon and rayon-polyester blends. The only limitation with respect to the fabric is that the fabric must have sufficient thermal stability to withstand either the heat and pressure of the transfer press, or the heat of the thermal printer where the graphic is printed directly on the fabric. Moreover, since binder is applied only to the print area of the fabric according to the invention and the resin shadow typical of the prior art is eliminated, the invention can be used with fabric of any color.

BRIEF DESCRIPTION OF THE DRAWINGS

FIG. 5(*b*) is a cross-section of a second transfer ribbon for use the alternative embodiment of the invention.

DETAILED DESCRIPTION OF THE INVENTION

Figure 1:
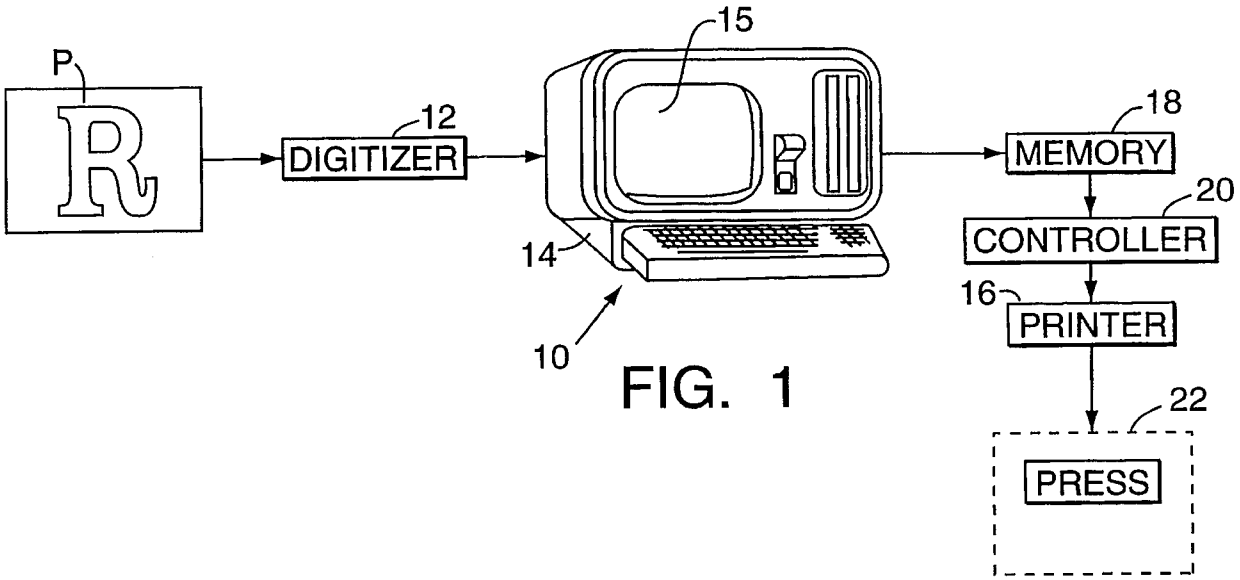
FIG. 1 is a schematic diagram illustrating a system for printing graphics on fabric according to the present invention.

FIG. 1 illustrates a microprocessor based system, generally designated 10, having apparatus for printing graphics on fabric. To print a graphic, such as the graphic P, the system 10 includes a digitizer 12 or other data input device which supplies a computer 14 with machine readable data defining the graphic to be printed. From the data defining the graphic, the computer 14 generates a printing program for operating a thermal printer 16 that prints the graphic on a thermally stable substrate. The program is stored in memory 18, and when the graphic is to be printed, a controller 20 reads the program and operates the printer. Once the graphic has been printed on the substrate, it is transferred from the substrate to the fabric in a thermal transfer step carried out in press 22.

Figure 2:
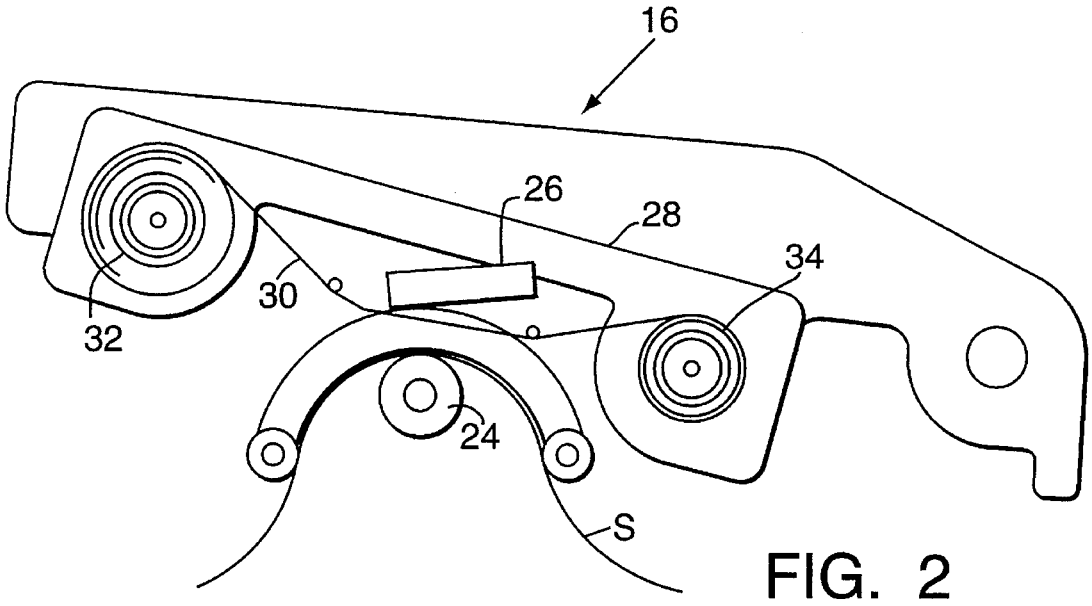
FIG. 2 is a schematic side view of a thermal printer for use in the system shown in FIG. 1.

A thermal printer useful in practicing the invention is illustrated schematically in FIG. 2. The printer, generally designated 16, includes a roller platen 24 over which the thermally stable substrate S passes relative to a thermal print head 26. The substrate S is supplied in sheet or strip form and may be any thermally stable medium known to those skilled in the art for use in thermal transfer printing processes. However, in the illustrated embodiment of the invention, the substrate S is either a thermal paper available from, for example Hobart-Macintosh, Inc., Elk Grove Villiage, Ill., under the trade designation "SOFTtrans", coated with a paraffin-based wax, or a polyethylene coated paper available from, for example, Lamart Corp., Clifton, N.J.

As the thermal paper passes over the platen 24, the print head is pressed downwardly onto the paper and generally establishes a linear zone of contact between the paper and the platen. A cassette 28 supplies a thermal transfer ribbon 30 which carriers a colorant and a binder. The ribbon 30 extends from a supply roll 32, between the print head 26 and the platen 24, to a take-up roll 34 of the cassette. Thus, as the print head 26 presses down on the platen 24 with the thermal paper and ribbon 30 interposed therebetween, the colorant and binder carried by the ribbon are transferred to the paper according to the data defining the graphic.

A more complete description of the printer 16 may be found in coassigned patent application Ser. No., 08/007,662, filed on Jan. 22, 1993, the disclosure of which is incorporated herein by reference. It should be understood, however, that the present invention is in no way limited in this regard and that any one of a wide variety of thermal printers already known to those skilled in the art may be substituted.

Figure 3:
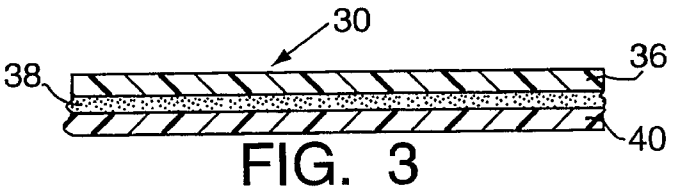
FIG. 3 is a cross-section of a transfer ribbon for use in the printer illustrated in FIG. 2.

Referring now to FIG. 3, in the preferred embodiment of the invention the ribbon 30 includes a carrier layer 36, a layer of colorant 38 supported on the carrier layer and a layer of binder 40 supported on the colorant layer. The layer 36 may comprise any material typically employed as a carrier in prior art thermal transfer ribbons. In most ribbons the carrier is formed from polyester and that is the material which comprises the carrier in the illustrated embodiment.

As mentioned above, the colorant layer 38 comprises pigment dispersed in a wax, a resin or wax-resin vehicle. Typical wax vehicles include, for example, carnauba, montan, beeswax, ceresine, haze, candelila, spermaceti, paraffin and microcrystalline wax. Resin vehicles used in formulating the colorant layer include, for example, low molecular weight polyethylene and polystyrene, vinyl polystearate, petroleum resins, polyamide resins, acrylic resins, PVC, PVA and ethylene-vinyl acetate copolymers. Mixtures of these and other waxes and resins well-known to those skilled in the art are also used to formulate the colorant layer. The colorant layer may further include additional compounds such a softening agents and plasticizers.

For multi-color graphics, the ribbon may include only a single pigment in the colorant layer, in which case the cassette 28 must be changed as each color of the graphic is printed sequentially. Alternatively, the ribbon 30 may be formulated with a standard CMYK colorant layer set, in which case process color printing can be carried out with a single cassette to print the multicolored graphic on thermal paper.

Turning now to the binder for adhering the pigment to the fabric, the layer comprises a film-forming binder provided on the ribbon 30 in a dissolved or finely dispersed homogeneous state. The binder must exhibit sufficient printability to be printed easily and precisely on the thermal paper by the printer 16, and, when eventually transferred to the fabric by the heat and pressure generated by the press 22, the binder must form a clear, colorless film of uniform thickness which encloses the pigment and adheres it to the fibers. Synthetic polymer binders based on acrylic acid and butadiene and vinyl acetate are preferred. Binders that have been found to be particularly suitable include an acrylic colloidal solution available from Johnson Polymer, Racine Wis., under the trademark JONCRYL 91, an acrylic aqueous solution available from Lawter International, Inc. under the trade designation HYDRO-REZ 2000, and an acrylic aqueous solution available from Miles, Inc., Pittsburgh, Pa. under the trade designation Acramin Binder GD.

Since the pigment and its binder are provided on a single ribbon, the graphic P can be printed on the thermal paper S in a single step for subsequent transfer to the appropriate fabric. Furthermore, since the binder 40 is carried by the ribbon 30 and is not provided as a coating on the thermal paper, binder is transferred onto the fabric according to the data comprising the printing program stored in memory 18. Thus, the method of printing taught by the present invention eliminates the disadvantages of prior art methods of printing on fabric, wherein the entire surface of the fabric is coated with binder, including the non-print areas not covered by the graphic.

In the most preferred embodiment of the invention, the ribbon 30 comprises a general purpose high speed wax ribbon available from, for example, Advent Corporation, Ellington, Conn., under the trade designation AD-102HS, coated with an acrylic binder. The Advent ribbon includes a base or carrier layer of polyester having a thickness of about 4.5 μm, which supports a pigmented wax ink having a melting point of about 70° C. and an optical density of about 1.85. The acrylic binder comprises 90 weight % "Acramin GD", 10 weight % "Acrafix MA" (Miles, Inc., Pittsburgh, Pa.), and a non-ionic surfactant added at 1% by weight of the total solution.

Figure 4:
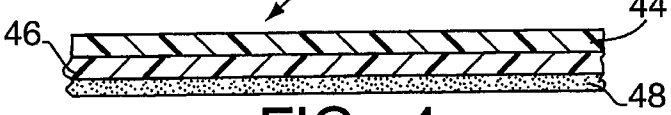
FIG. 4 is a cross-section of another transfer ribbon for use in the printer illustrated in FIG. 2.

Referring now to FIG. 4, a second ribbon 42 is shown for printing a graphic directly on fabric without the need for a thermal transfer step. According to this aspect of the invention, the ribbon 42 includes a polyester carrier layer 44, a layer of binder 46 supported on the carrier layer, and a colorant layer 48 supported on the binder layer. The composition of the layers 44, 46 and 48 are identical to the corresponding layers described above with respect to the ribbon 30, except that the positions of the binder and colorant layers are reversed on the ribbon 42. By forming the ribbon 42 with the pigment in the outermost layer, and supplying the fabric directly to the printer in place of the thermal paper as the substrate S, it has been found that the thermal printer 16 can be used to print pigment and binder directly onto the fabric according to the data comprising the printing program. Thus, the step of transferring the graphic from the thermal paper to the fabric in the press 22 is entirely eliminated. The only limiting factor here is that the fabric must be capable of withstanding the heat generated by the thermal printer without degrading.

Figure 5A:
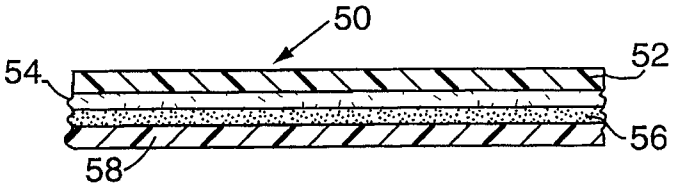
FIG. 5(*a*) is a cross-section of a transfer ribbon for use with an alternative embodiment of the invention.
Figure 5B:
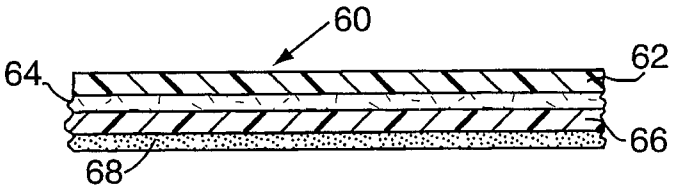

Whether the ribbon is constructed in the manner described in connection with ribbon 30 or ribbon 42, it is desirable when using a resin, a wax or a wax/resin vehicle for the pigment to include a release layer between the polyester carrier and the immediately adjacent layer of either colorant or binder. Any suitable release agent may be utilized as long as it provides the release layer with a melting point which is lower than the melting point of the colorant. FIGS. 5(*a*) and 5(*b*) illustrate ribbons useful in carrying out this aspect of the invention. As shown in FIG. 5(*a*), the ribbon includes a carrier layer 52, a release layer 54 supported on the carrier layer, a colorant layer 56 supported on the release layer, and a binder layer 58 supported on the colorant layer. Alternatively, the ribbon 60 shown in FIG. 5(*b*) includes a carrier layer 62, a release layer 64 supported on the carrier layer, a binder layer 66 supported on the release layer, and a colorant layer 68 supported on the binder layer.

In addition to the above-described methods for printing a graphic on fabric, the invention encompasses a method wherein a thermal printer, such as the printer illustrated in FIG. 2, and an associated ribbon are used to print colorant, according to data defining the graphic to be printed, onto a thermally stable substrate, such as thermal paper, coated with a film of resin binder. A computer-controlled plotter having a cutting blade and provided with machine-readable data defining the graphic is then used to cut around the graphic, after which those portions of the resin film which are not covered with colorant are removed. Thus, according to this method, the thermal transfer comprises the thermally stable substrate covered with resin and colorant only in the print area corresponding to the graphic.

In yet another embodiment of the invention, a thermally stable substrate, such as thermal paper, is coated with resin binder. A barrier layer which prevents release of the binder from the substrate in the transfer press is then printed onto the non-print areas of the substrate. Using a standard ribbon, colorant is then printed onto the print area of the substrate according to data defining the graphic to be printed. Accordingly, when the graphic is transferred to the fabric in the transfer press, binder is transferred to the fabric in the print area only.

In a modification of the above-described method, a dry resin is coated onto the thermally stable substrate. The resin forms one part of a two-part binder system which also includes a microencapsulated activator for the resin dispersed in the colorant layer carried by the ribbon. After the printer applies colorant to the substrate according to data defining the graphic to be printed, the microcapsules are ruptured by the pressure applied in the transfer press, and the activator is released into the resin. Accordingly, only the print area of the substrate, i.e., that portion of the resin coated substrate which is covered by the colorant, is made tacky by the activator. Of course, the activator does not have to be incorporated into the colorant layer, but instead could comprise either a separate layer on the same ribbon carrying the colorant or on a second ribbon used in a second printing operation.

We claim:

1. A method for printing a graphic on fabric, said method comprising the steps of:

(a) providing a thermal transfer printer having a ribbon including a carrier layer and a layer of colorant supported on the carrier layer;

(b) providing the thermal printer with data defining the graphic to be printed on the fabric;

(c) coating a thermally stable substrate with a film of binder for the colorant (d) causing the thermal printer to print the colorant onto the substrate according to the data to form a print area on the substrate including binder and colorant and an adjacent non-print area of the substrate including the binder film only;

(e) removing the binder film from the non-print area of the substrate; and (f) thermally transferring the colorant and binder from the print area of the substrate to the fabric to print the graphic on the fabric.

2. The method of claim 1 wherein the colorant is a colorant layer dispersed in a vehicle selected from the group consisting of: wax, resin and wax-resin.

3. The method of claim 1 wherein the carrier layer of the ribbon is polyester.

4. The method of claim 1 wherein the step of providing the thermal printer with data includes:

providing a data input device with machine-readable data;

providing a computer for operating a printing program which defines the graphic to be printed by the thermal transfer printer; and supplying machine-readable data from the data input device to the printing program of the computer for operating the thermal printer to print the graphic.

5. The method of claim 1 wherein the thermal substrate is a thermal paper.

6. The method of claim 1 wherein the binder is a resin binder.

7. The method of claim 1 wherein the step of removing includes:

providing a computer-controlled plotter having a cutting blade providing machine-readable data for defining the graphic; and cutting around the graphic and removing portions of the binder film which are not covered by the colorant.

8. The method of claim 1 wherein the step of thermally transferring includes:

providing a transfer press; and applying heat and pressure to the fabric via the transfer press.

* * * * *